US005491999A

United States Patent [19]

Holloway

[11] Patent Number: 5,491,999

[45] **Date of Patent: * Feb. 20, 1996**

[54] GRIPPER MEANS FOR STRETCHER LEVELER APPARATUS

[76] Inventor: Bertram A. Holloway, 150 Karen Dr., Washington, Pa. 15301

[ * ] Notice: The portion of the term of this patent subsequent to Jan. 8, 2008, has been disclaimed.

[21] Appl. No.: 893,671

[22] Filed: Jun. 5, 1992

Related U.S. Application Data

[63] Continuation-in-part of Ser. No. 782,416, Oct. 25, 1991, Pat. No. 5,181,411, which is a continuation of Ser. No. 575,167, Aug. 29, 1990, Pat. No. 5,077,807, which is a division of Ser. No. 376,387, Jul. 6, 1989, Pat. No. 4,982,593, which is a continuation-in-part of Ser. No. 819,028, Jan. 15, 1986, abandoned, which is a continuation-in-part of Ser. No. 485,275, Apr. 15, 1983, abandoned.

[51] Int. Cl.[6] ..... B21D 25/04

[52] U.S. Cl. ..... 72/302; 269/274; 269/286

[58] Field of Search ..... 72/302; 269/279–284, 269/286, 274; 81/422, 423, 418, 424.5, 900, 186

[56] References Cited

U.S. PATENT DOCUMENTS

| | | | |
|---|---|---|---|
| 1,863,011 | 6/1932 | Hach | 269/279 |
| 2,519,107 | 8/1950 | Brown | 269/275 |
| 2,766,649 | 10/1956 | Labry | 269/274 |
| 2,796,787 | 6/1957 | Aske | 269/274 |
| 2,809,130 | 10/1957 | Rappaport | 156/310 |
| 2,980,046 | 4/1961 | McGregor | 72/350 |
| 3,047,934 | 8/1962 | Magner | 264/265 |
| 3,290,199 | 12/1966 | Willhoite | 264/135 |
| 3,322,423 | 5/1967 | Popow | 269/274 |
| 3,777,529 | 12/1973 | Kaufmann | 72/465 |
| 4,114,245 | 9/1978 | Bainard | 264/135 |
| 4,198,037 | 4/1980 | Anderson | 264/235 |
| 4,335,873 | 6/1982 | Kiefer | 269/274 |
| 4,462,581 | 7/1984 | Mitani | 269/283 |
| 5,024,428 | 6/1991 | Ramsay | 269/279 |

FOREIGN PATENT DOCUMENTS

| | | | |
|---|---|---|---|
| 200893 | 6/1955 | Australia | 72/302 |
| 255060 | 12/1912 | Germany | 269/282 |
| 422944 | 12/1925 | Germany | 269/281 |
| 168501 | 7/1934 | Switzerland | 72/302 |
| 198103 | 6/1967 | U.S.S.R. . | |

*Primary Examiner*—Daniel C. Crane
*Attorney, Agent, or Firm*—Ansel M. Schwartz

[57] ABSTRACT

The present invention is an element for gripping metal to be stretched by a stretcher leveler apparatus. The gripping element includes a first and preferably a second high density cast polyurethane gripping pad adapted for engagement with the metal to be stretched and a support member which can be a rectangular plate upon which the first and second gripping pads are operatively anchored. The support member having two pads is detachably mounted to the stretcher leveler apparatus either in a first orientation in which the first pad is positioned for engagement with the metal to be stretched or a second orientation in which the second pad is positioned for engagement with the metal to be stretched. Preferably, the support member is a plate having a first support surface upon which the first gripping pad is chemically bonded and a second support surface upon which the second gripping pad is chemically bonded. The support surfaces are disposed on opposite sides of the plate and in a parallel relationship. The gripping pads are preferably cast in situ on the support member. Preferably, at least one threaded hole is disposed at either end of the support member for allowing attachment to the stretcher leveler apparatus with threaded fasteners.

14 Claims, 3 Drawing Sheets

GRIPPER MEANS FOR STRETCHER LEVELER APPARATUS

RELATED PATENTS

This is a continuation-in-part of U.S. patent application Ser. No. 07/782,416 filed Oct. 25, 1991, now U.S. Pat. No. 5,181,411, which is a continuation of Ser. No. 07/575,167 filed Aug. 29, 1990, now U.S. Pat. No. 5,077,807, which is a divisional of Ser. No. 07/376,387 filed Jul. 6, 1989, now U.S. Pat. No. 4,982,593, issued Jan. 8, 1991, which is a continuation-in-part of Ser. No. 06/819,028 filed Jan. 15, 1986, now abandoned, which is a continuation-in-part of Ser. No. 06/485,275 filed Apr. 15, 1983, now abandoned.

FIELD OF THE INVENTION

The present invention relates in general to an improved gripper element for use with a stretcher leveler device. More specifically, the present invention relates to a gripping element for a stretcher leveler device which eliminates surface disfigurement of the metal being stretched.

BACKGROUND OF THE INVENTION

The two primary methods of providing straight or flattened steel strip or sheet are roller leveling and stretcher leveling. Roller leveling is typically performed in a rolling machine consisting of two sets of rolls. A top and bottom set of several small diameter horizontal rolls each are mounted in a housing so that the associated top and bottom rolls are offset from each other. A steel sheet or strip passing through the leveler is flexed up and down alternately between the offset rolls such that the amount of flexing decreases as the sheet travels toward the exit end of the roller leveler. The rolls nearest the exit end are designed to perform the basic straightening operation. The advantage of roller leveling is that long lengths of sheets or strip may be leveled or flattened with minimum surface disfigurement. However, roller leveling does not impart the same degree of flatness to the sheet as a pair of opposing jaws actuated by hydraulic or pneumatic means.

Typically, sheet or strip is elongated between one and three percent so that the elastic limit of the steel is exceeded to produce permanent elongation. There are numerous types of stretcher leveler devices including those which can handle large coils of rolled strip. However, in all stretcher levelers the jaws of the device include gripping means to securely grip the opposing ends of the sheet which is to be stretched. These gripper means typically comprise a flat elongated engagement member having a length slightly greater than the width of the sheet or strip to be stretched. The surface of the engagement member which is adapted to engage or grip the surface of the sheet or strip to hold it against movement during elongation is very rough, normally grooved, knurled or serrated. Consequently, in virtually all such stretcher leveler devices the gripper means bite into the metal and disfigure the surface of the sheet. Traditionally, the disfigured portion of the sheet or strip is marked and subsequently cut off as scrap. For example, in a coil 2,125 feet in length, approximately 162" are lost in scrap.

The disfigurement of the metal results in substantial economic loss because that metal is normally discarded as waste. Moreover, when coils of rolled strips are stretched in sequential stretching, the gripper disfigurement marks must be indicated and cut from the coil. Thus, the maximum length of strip or sheet which could be leveled is the distance between the grippers.

U.S. Pat. No. 4,982,593 discloses a stretcher leveler apparatus having an element for gripping metal which does not disfigure the metal. The element has a single gripping surface comprised of high density cast polyurethane, which can grip the metal without slipping. U.S. Pat. No. 5,077,887 discloses a method of making a stretcher leveler gripping element wherein polyurethane is cast in situ onto a steel support surface, to form a gripping pad which is permanently bonded to the support surface.

The present invention provides an improved gripper element which can be quickly replaced and withstand greater forces than heretofore known.

SUMMARY OF THE INVENTION

The present invention is an element for gripping metal to be stretched by a stretcher leveler apparatus. The gripping element includes first and second high density cast polyurethane gripping pads adapted for engagement with the metal to be stretched and a support member upon which the first and second gripping pads are chemically bonded. The support member is detachably mounted to the stretcher leveler apparatus either in a first orientation in which the first pad is positioned for engagement with the metal to be stretched or a second orientation in which the second pad is positioned for engagement with the metal to be stretched. Preferably, the pads form hydrogen bonds with the support member.

Preferably, the support member is a plate having a first support surface upon which the first gripping pad is anchored and a second support surface upon which the second gripping pad is anchored. The support surfaces are disposed on opposite sides of the plate and in a parallel relationship. The gripping pads are cast in situ on the support member to form a chemical bond therewith. Preferably, at least one threaded hole is disposed at either end of the support member for allowing attachment to the stretcher leveler apparatus with threaded fasteners.

The present invention is also a gripping element having a high density cast polyurethane gripping pad adapted for engagement with the metal to be stretched and an essentially rectangular support plate having a first planar support surface upon which the gripping pad is chemically bonded.

The present invention is also a method for producing a stretcher leveler gripping element. The method includes the step of providing a rectangular support plate having a first support surface. Then, there is the step of pouring polyurethane material onto the first support surface. Next, there is the step of allowing the polyurethane material to solidify on the first support surface such that it chemically bonds to it, thereby forming a first polyurethane gripping pad on the support plate so that the polyurethane gripping pad acts to grip the metal being stretcher leveled within the stretcher leveler apparatus.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1A:
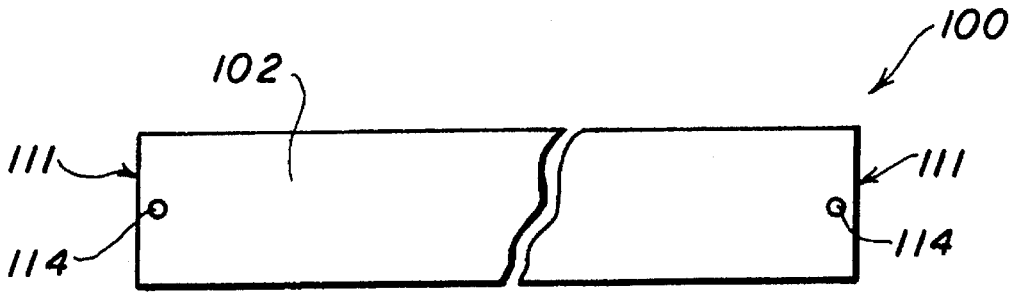
FIGS. 1*a*–1*c* are schematic representations showing top, front and side views of an element for gripping metal.
Figure 1B:
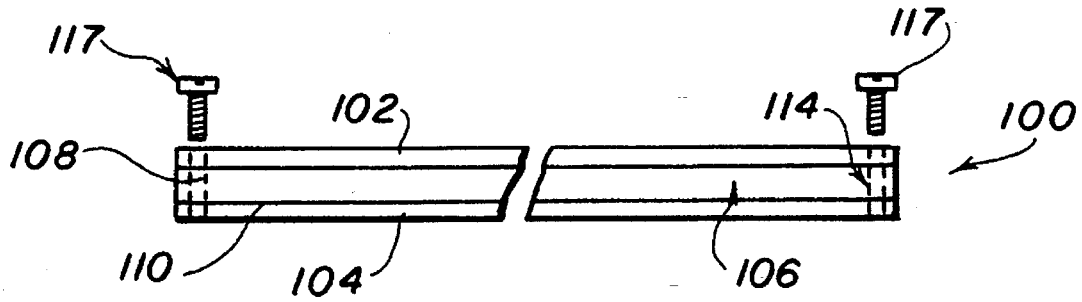
Figure 1C:
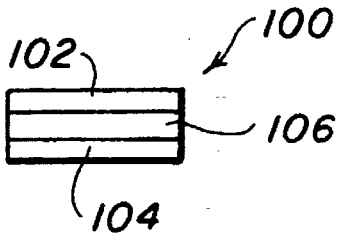

Referring now to the drawings wherein like reference numerals refer to similar or identical parts throughout the several views, and more specifically to FIGS. 1*a*–1*c* thereof, there is shown an element 100 for gripping metal to be stretched by a stretcher leveler apparatus. The element 100 is double-sided so that when one gripping surface wears out, it is necessary only to flip the gripping element 100 over to expose a new gripping surface to the metal coil. The metal to be stretched can include steel, titanium, aluminum, alloys of various metals, etc., to name but a few of the many metals that can be stretched. Essentially, any material that has a modulus of elasticity could be considered for flattening using element 100 in a stretcher leveler. The metal to be stretched is preferably no thicker than ½ inch with respect to coil. Greater thickness sheets could be stretched but would not be in coil form.

The gripping element 100 is comprised of a first high density cast polyurethane gripping surface or pad 102 adapted for engagement with the metal coil 20 to be stretched and a second high density cast polyurethane gripping surface or pad 104 adapted for engagement with the metal coil 20 to be stretched. There is also a common support member 106 upon which the first and second gripping pads 102 and 104 are chemically bonded. The support member 106 is adapted to be detachably mounted to the stretcher leveler apparatus either in a first orientation in which the first pad 102 faces the metal coil 20 or a second orientation in which the second pad 104 faces the metal coil. Preferably, the first and second gripping pads 102 and 104 have chamfered corners.

In one embodiment, the support member 106 is an essentially rectangular plate of tempered carbon steel, such as 4140 carbon steel, which has a first support surface 108 and a second support surface 110 upon which the first and second gripping pads 102, 104 are chemically bonded, respectively. Support member 106 can be made of any steel that is tempered enough to eliminate any deformation of the support member 106 during the stretching operation. The metal to be stretched must be forced to conform to the flatness of the support member 106 to insure full contact therewith. If the member 106 is not made from a material with sufficient strength to insure this, the member 106 must be removed from service and reworked. The full contact also insures nonslippage between the metal to be stretched and the pad 102, 104 by providing the largest surface area possible with respect to friction.

Preferably, the gripping pads 102 and 104 can be chemically bonded to their respective support surface 108, 110 by casting molten polyurethane directly onto the support surfaces 108, 110 to form hydrogen bonds between the gripping pads 102, 104 and their respective support surface 108, 110.

As shown in FIGS. 1*a*–1*c*, each gripping element 100 is attached to the stretcher leveler through two holes 114 disposed at either end of the gripping element 100. Each hole 114 has an axis that is perpendicular to the plane of the gripping element. Preferably, each hole 114 is 9/16 inch diameter and is 2 inches from the closest end 111 of the element 100. Two screws 117 are inserted through the holes 114 and screwed directly into a mounting plate 115 (see FIG. 2) of the stretcher leveler apparatus. Alternatively, two threaded holes having an axis essentially parallel to the plane of the support member 106 (not shown) can be provided at either end 111 of the support member 106. In this embodiment, screws are threaded directly into the support member 106 to attach it to the stretcher leveler apparatus.

Figure 3:
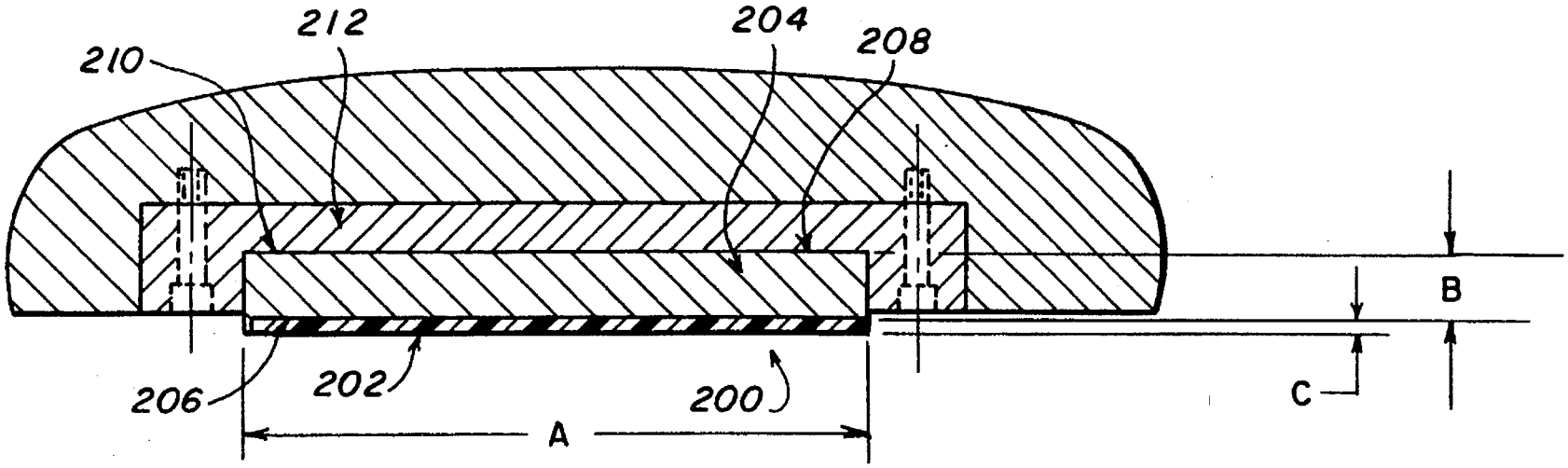
FIG. 3 is a schematic representation showing an alternative embodiment of an element for gripping metal.

As shown in FIG. 3, there is shown a preferred embodiment of element 200 for gripping metal to be stretched in a stretcher leveler apparatus 10 which specifically defines a rectangular support plate having at least one gripping pad. The element 200 has a high density cast polyurethane gripping pad 202 for engagement with the metal to be stretched and an essentially rectangular support plate 204 having a first planar surface 206 upon which the gripping pad 202 is chemically bonded. The gripping pad 202 can have a durometer of 85 to 100 and preferably 90–95. Too soft of a durometer and too thick of a pad 202 results in the pad 202 being torn during the stretching process. Also, too soft a durometer results in the shape of the support plate being imprinted on the metal being stretched. Preferably, the support member 204 also has a second planar surface 208 disposed opposite to said first surface 206 to which a second high density cast gripping pad is chemically bonded.

The gripping element 200 is adapted for placement within a rectangular recess 210 of a mounting plate 212 of the stretcher leveler apparatus 10. If the gripping element 200 has two polyurethane gripping pads, one of the gripping pads is disposed within the recess 210 while the other gripping pad is used to stretch metal. The gripping element 200 has a hole 214 disposed at either end for allowing it to be removably attached within the recess 210 with screws 216. The gripping element 200 can be between 24 and 100 inches long and preferably is 52 inches long, and can be between 8 and 20 inches in width and is preferably 12.5 inch in width as shown as reference character A in FIG. 3. The gripping element 200 length is not critical so long as its working surface length exceeds the width of the metal being stretched. The dimension of the width of the element 200 is determined by the metal being stretched, and is dictated by the thickness and modulus of elasticity of the metal being stretched. The success of the invention is determined by friction and the face width of the element 200 being wide enough to eliminate slippage of the pad 202 over the metal during stretcher leveling. Preferably, the support member 204 has a thickness of 0.125 to 2.5 inches and preferably 1.25 inch as shown as reference character B. Preferably, the thickness of the gripping pad 202 is between ⅛ and 1 inch and preferably is 0.25 inch as shown as reference character C in FIG. 3. The element's 200 thickness can vary depending on the forces involved with the product being processed. The gripping element 200 of the preferred embodiment can support in excess of 600 tons of force applied to it to stretch the metal. Essentially, the constraints identified with respect to the gripping element 100 is also applicable to gripping element 200.

The present invention is also a method for producing a stretcher leveler gripping element. The method includes the step of providing a rectangular support plate having a first support surface. Then, there is the step of pouring polyurethane material onto the first support surface. Next, there is the step of allowing the polyurethane material to solidify on the first support surface such that it chemically bonds to it, thereby forming a first polyurethane gripping pad on the support plate so that the polyurethane gripping pad acts to grip the metal being stretched within the stretcher leveler apparatus. Preferably, before the pouring step, there is the step of applying adhesive to the support surface and the pouring step takes place in a vacuum.

Figure 2:
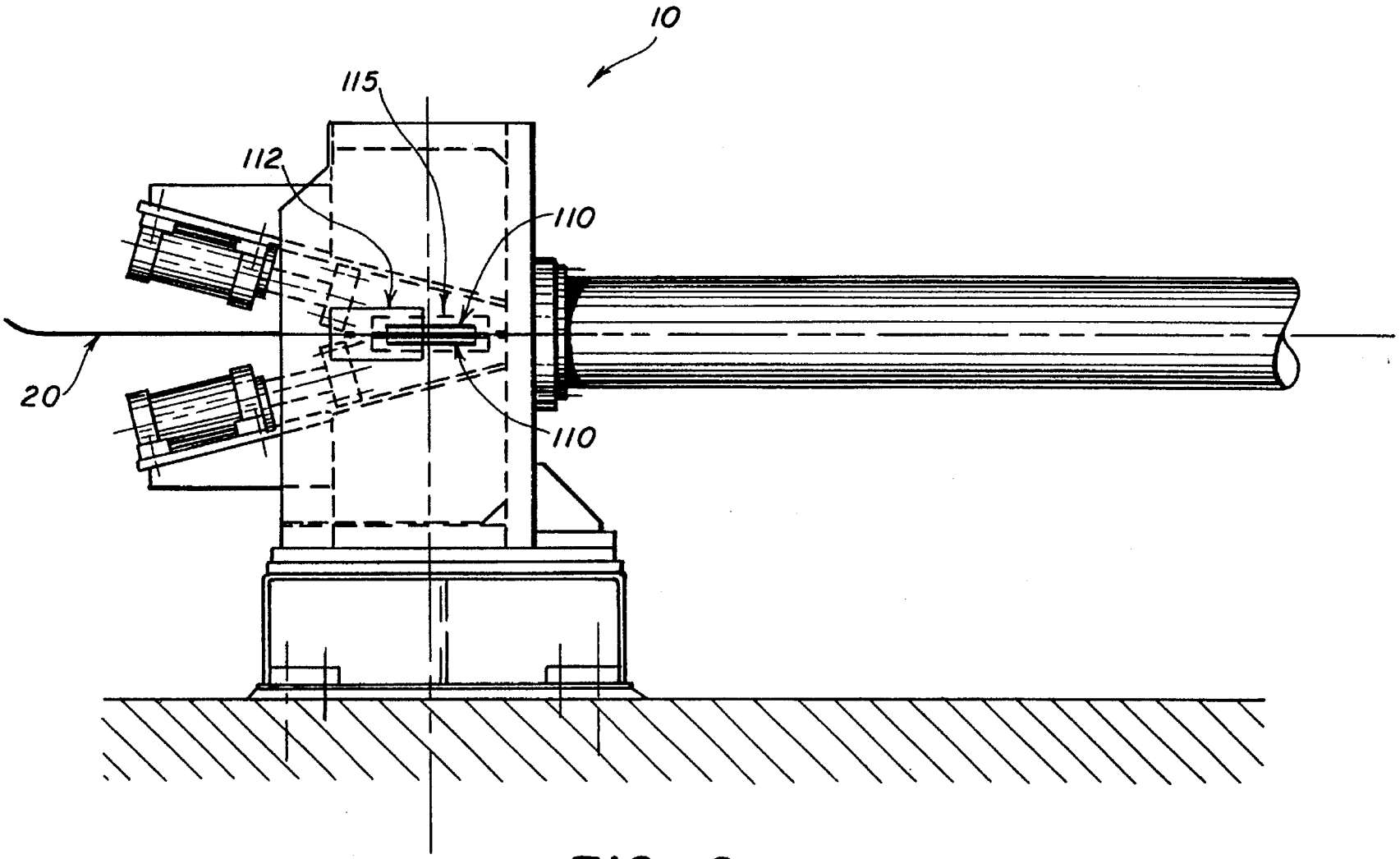
FIG. 2 is a schematic representation of the gripping element in relation to a stretcher leveler apparatus.

In the operation of the invention, and as shown in FIG. 2, the stretcher leveler apparatus 10 is provided with access openings 112 at each end through which gripping element 100 is inserted. Each gripping element is 52 inches long and 12.50 inches wide and has two gripping pads 102 and 104 which were cast in situ onto the support member 106 to form a chemical bond therewith. The gripping pads 102 and 104 have a 0.25 inch thickness. The support member 106 has a thickness of 1.38 inches. The gripping pads 102 and 104 are comprised of Adiprene®.

A particularly suitable polymeric material for forming the gripping pads is Adiprene 410 liquid resin. The liquid polymeric is poured upon the prepared carbon steel support member 106 and then is cured in situ to form one or two cast rigid gripping pads 102 and 104. It is preferable, however, to precoat the support member 106 with thixon (R) adhesive as a base, before the pour application of the preferred polyurethane resin. This will ensure the cast gripping surface's adhesion to the support member 106, despite the massive shearing pressure that the gripping elements will undergo while up to 600 tons of tensile stress are repetitively placed upon the extended coil length to achieve the conventional stretcher leveler process, required in selective steel sheet applications. As stated before, the tons of tensile stress applied to the metal being stretched is dependent upon the metal being stretched. Thus, greater than 600 tons can be applied if necessary.

The casting, in situ, on the support member 26 preferably occurs in a vacuum or as close to a vacuum as possible. The method of casting is preferably accomplished by first evacuating a chamber having the support member 106. Then, the polymeric material is heated until it liquifies (200° F. for polyurethane) and poured on the support surface of the support member 106. The liquid polymeric material is allowed to solidify and form the gripping pad 102. During this entire operation, the chamber is evacuated to minimize the potential for bubbles forming in the gripping pad 102. Any bubbles in the gripping pad 102 could weaken the gripping pad 102 or allow the gripping element 100 to mar the metal being stretched along a deformity in the gripping pad 102 where a bubble has caused an opening in the surface. When completed, the element 100 is turned over and the same process is repeated to form the other pad 104.

A pair of gripping elements 100 are then inserted through each access opening 112. The pair of gripping elements 100 are then attached to the stretcher leveler apparatus with screws or locks through holes 114. For purpose of discussion, the gripping elements 100 are originally inserted in their first orientation with the first gripping pads 102 facing the metal to be stretched. The metal 20 is then stretched in accordance with the invention, until one or more of the gripping pads 102 wear out or a set time has passed. At this point, the advantage offered by the gripping elements 100 is readily apparent. Instead of replacing the gripping element 100 altogether, it is necessary only to turn each gripping element 100 over to its second orientation, such that the second, unused gripping pad 104 faces the metal 20. Preferably, all four gripping elements 100 (two per each side of the stretcher leveler) are turned at the same time. After turning, the stretcher leveler 10 can be operated for another period until the second gripping pads 104 of the gripping elements wear out or the set time has passed. After both pads 102 and 104 of the gripping element 100 are worn out, it is then necessary to replace the entire gripping element 100 with a new one, having two fresh pads 102, 104. Of course, if element 200 having only one gripping pad 202 is used, then the element 200 must be completely replaced when gripping pad 202 is worn down. Alternatively, the pad 202 can be remachined and reinserted.

The carbon steel support surface forms an effective gripper only when polyurethane elastomer is cast in situ on it because the support surface is composed of oxides and hydroxides of iron which can mechanically and hydrogen bond to the polyurethane elastomer. Moreover, when the thixon adhesive (403/404 type adhesive) is utilized (although it is not needed), hydrogen bonds are further created through the adhesive as well as through the fact that the thixon adhesive is a good wetting agent and easily flows into the grooves and irregular surfaces of the steel support surface. This facilitates the formation of hydrogen bonds between the polyurethane elastomer and the carbon steel support structure with the iron oxide and/or iron hydroxide bonds of steel. In addition, Vander Waals forces and other secondary bonding forces add considerably to the steel/adhesive bond.

When the molten polyurethane elastomer is cast in situ on the steel support surface, the adhesive sets and is able to chemically cross-link with the diisocyanates in the polyurethane by way of the adhesive's amine or active hydroxyl groups. Hydrogen bonding and other secondary bonding forces such as Vander Waals forces complete the tight bonding between the adhesive and the polyurethane coating. As it cures, the polyurethane elastomer hydrogen bonds and form secondary bonds to the steel support surface. Through use of the adhesive's excellent wetting properties there is formed a strong mechanical bond to the steel in the form of a lock and key effect. This three way bonding is useful because cast materials don't always bond well to steel alone.

With respect to the specific brand of polyurethane elastomer adiprene 410 liquid resin, it is made in three steps which are the following:

1. A basic intermediate is first prepared in the form of a low molecular weight polymer with hydroxyl end groups.

2. The basic intermediate, which is here designated "B" is then reacted with the aromatic diisocyanate to give a prepolymer.

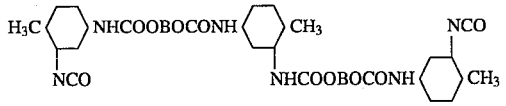

3. The elastomer polyurethane is then vulcanized through the isocyanate groups by reactions with glycols. This leads to cross linkages like the disulfide cross linkages found in vulcanized rubber.

The polyurethane elastomer vulcanization sets up a tenuous network of primary chemical bond cross links which inhibit the irreversible flow characteristics of the molten state but permit the local freedom of motion of the polymer chains. This gives the polyurethane the elastic properties that are associated with typical rubbers. Thus, by vulcanization, the flow of the polyurethane elastomer is decreased, its tensile strength and modulus is increased and its extensibility is preserved.

Although vulcanized rubbers are very elastic, they do not exhibit the tensile strength, toughness, abrasion resistance and tear resistance of the elastic polyurethane. The abrasion resistance of both natural and SBR rubber can be improved at the 5-fold by proper reinforcement but the resilience of rubber decreases with the increasing load of filler. Tests show that reinforcing filler represents a compromise between adequate abrasion and tear resistance and abnormal heat build up.

The elastomer polyurethane is very important for another reason, it is the only coating that is able to be cast directly on the metal. This is because the irreversible flow characteristics of the molten state are inhibited by the primary chemical bond cross links introduced by vulcanization. For example, pure nylon (Nylon 6) as in Magner's U.S. Pat. No. 3,047,934 *Bonding Nylon to Steel* and polyethylene are semicrystalline solids at room temperature. These bunches of little crystals give mechanical stability at room temperature but do not preserve their dimensional stability above a certain temperature. If either is heated above their melting point they flow away from the steel. They also do not exhibit the same elasticity or abrasion resistance of polyurethane.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An element for gripping metal to be stretched by a stretcher leveler apparatus comprising:

a first high density cast polyurethane gripping pad adapted for engagement with the metal to be stretched;

a second high density cast polyurethane gripping pad adapted for engagement with the metal to be stretched; and a support member having a plate having a first support surface which forms hydrogen bonds with the first gripping pad and a second support surface which forms hydrogen bonds with the second gripping pad, said support surfaces disposed on opposite sides of the plate and in a parallel relationship, said gripping pads are also adhesively bonded to their respective gripping surface, said support member detachably mounted to the stretcher leveler apparatus either in a first orientation in which the first pad is positioned for engagement with the metal to be stretched or a second orientation in which the second pad is positioned for engagement with the metal to be stretched.

2. An element as described in claim 1 wherein each gripping pad is cast in situ on its respective support surface.

3. An element as described in claim 2 wherein the support member is comprised of tempered carbon steel.

4. An element as described in claim 3 wherein each pad is between 1/16" and 3/16" thick.

5. An element as described in claim 4 wherein the gripping pads have chamfered corners.

6. An element as described in claim 5 wherein each gripping pad is between 30 and 70 inches long and between 8 and 20 inches wide.

7. An element as described in claim 6 wherein at least one hole is disposed at either end of the support member for allowing attachment to the stretcher leveler apparatus.

8. An element for gripping metal to be stretched by a stretcher leveler apparatus comprising:

a high density cast polyurethane gripping pad adapted for engagement with the metal to be stretched;

second high density cast polyurethane gripping pad adapted for engagement with the metal to be stretched; and an essentially rectangular support plate having a first planar support surface and a second planar surface that is in parallel with the first surface upon which the gripping pad and the second gripping pad, respectively, are hydrogen bonded.

9. An element as described in claim 8 wherein the gripping pad is cast in situ on its respective support surface.

10. An element as described in claim 9 wherein the support member is comprised of tempered carbon steel.

11. An element as described in claim 10 wherein the gripping pads and the support plate are 52 inches long and 12.5 inches wide.

12. An element as described in claim 11 wherein at least one hole is disposed through either end of the element for facilitating attachment of the element to the stretcher leveler apparatus.

13. An element for gripping metal to be stretched by a stretcher leveler apparatus comprising:

a first high density cast polyurethane gripping pad adapted for engagement with the metal to be stretched;

a second high density cast polyurethane gripping pad adapted for engagement with the metal to be stretched; and a support member to which the first and second gripping pads are chemically bonded with hydrogen bonds, said support member detachably mounted to the stretcher leveler apparatus either in a first orientation in which the first pad is positioned for engagement with the metal to be stretched or a second orientation in which the second pad is positioned for engagement with the metal to be stretched.

14. An element for gripping metal to be stretched by a stretcher leveler apparatus comprising:

a high density cast polyurethane gripping pad adapted for engagement with the metal to be stretched; and an essentially rectangular support plate having a first planar support surface upon which the gripping pad is chemically bonded with hydrogen bonds.

* * * * *